US006352175B2

(12) United States Patent
Izawa et al.

(10) Patent No.: US 6,352,175 B2
(45) Date of Patent: Mar. 5, 2002

(54) NOTE HOLDING AND DISPENSING DEVICE WITH CASSETTE

(75) Inventors: Hikaru Izawa; Kensuke Matsunaga; Yoshiaki Uemizo, all of Osaka (JP)

(73) Assignee: Japan Cash Machine Co., Ltd., Osaka (JP)

( * ) Notice: Subject to any disclaimer, the term of this patent is extended or adjusted under 35 U.S.C. 154(b) by 0 days.

(21) Appl. No.: 09/833,004

(22) Filed: Apr. 11, 2001

Related U.S. Application Data

(60) Division of application No. 09/420,383, filed on Oct. 19, 1999, which is a continuation-in-part of application No. 09/046,857, filed on Mar. 24, 1998, now Pat. No. 6,098,837.

(51) Int. Cl.[7] ..... B65H 1/00
(52) U.S. Cl. ..... 221/197; 902/14
(58) Field of Search ..... 221/97, 2, 7, 197, 221/154, 151; 271/145, 10.08, 34, 31.1; 90/13, 14, 17

(56) References Cited

U.S. PATENT DOCUMENTS 4,325,277 A * 4/1982 Uchida et al. ..... 83/205
4,447,097 A * 5/1984 Lafevers et al. ..... 312/215

* cited by examiner

*Primary Examiner*—Kenneth W. Noland
(74) *Attorney, Agent, or Firm*—Bachman & LaPointe, P.C.

(57) ABSTRACT

A note holding and dispensing device is provided which comprises a frame 16; a cassette 18 removably positioned in a cavity 112 of the frame 16; a transfer device 24 which comprises an extraction drive means 120 and a conveyer means 122 provided in the frame 16; and an electronic controller 46 for controlling operation of the extraction drive means 120 and conveyer means 122. The cassette 18 has a chamber 64 for receiving a plurality of notes 66 and an extracting device 232 for discharging the notes 66 from the chamber 64. The extraction drive means 120 operates the extracting device 232 in the cassette 18 to fetch the notes 66 from the cassette 18. The conveyer means 122 transports the notes 66 received from the cassette 18 to an outlet 20 through a passageway 22.

21 Claims, 10 Drawing Sheets

NOTE HOLDING AND DISPENSING DEVICE WITH CASSETTE

CROSS-REFERENCE TO RELATED APPLICATION

The instant application is a divisional of U.S. patent application Ser. No. 09/420,383 filed Oct. 19, 1999 which is a CIP of 09/046,857, filed Mar. 24, 1998, now U.S. Pat. No. 6,098,837.

This application is continuation-in-part of U.S. application Ser. No. 09/046,857, entitled NOTE HOPPER/DISPENSER, Filed Mar. 24, 1998, by Hikaru Izawa.

BACKGROUND OF THE INVENTION

1. Field of the Invention

The present invention is generally directed to the field of currency handling machines, and in particular to a note hopper for dispensing paper currency, bank notes or cash equivalent scrip.

2. Description of the Prior Art

The advent of wide-spread use of bill acceptors or currency validation units for use with gaming machines and vending machines has greatly increased the convenience to the user by allowing the use of paper bills in various denominations, as opposed to coins, to operate these types of machines. Generally, however, these types of machines only dispense money in the form of coins and they are incapable of dispensing paper currency. Coincidentally, the wide-spread use of automated transaction machines (ATMs) has provided the consuming public with ready access to paper currency from ATMs using a bank card or credit card and upon entry of user appropriate code information. Operationally, however, ATMs are predominantly intended to dispense currency in a single denomination from a secure location and they are thus little more than a note counting and dispensing apparatus.

For certain applications, such as gaming and vending machines having bill validation capabilities, there is a need for a bill or note dispenser which will interact with an electronic controller of the machine, to dispense currency, bills, or other secure notes.

An object of the present invention is to provide a note holding and dispensing device which can discharge notes from a cassette removably attached to a frame.

Another object of the invention is to provide a note holding and dispensing device which can recover unacceptable notes such as double or false notes without the discharging these notes to avoid trouble with users.

Still another object of the invention is to provide a note holding and dispensing device with a cassette which includes an extracting device wherein a frame supports an extraction drive means which drives the extracting device to manufacture the cassette in light weight.

A further object of the invention is to provide a light-weight note holding and dispensing device electrically connectable to a host machine.

A still further object of the invention is to provide a note holding and dispensing device with a cassette lock device for securing a cassette to a frame wherein delivery and recovery slots in the cassette can be opened and closed by operation of the cassette lock device for anti-theft.

SUMMARY OF THE INVENTION

A note holding and dispensing device according to the present invention comprises a frame (16) formed with a cavity (112); a cassette (18) removably positioned in the cavity (112) of the frame (16) for holding a plurality of notes (66); a transfer device (24) comprising an extraction drive means (120) and a conveyer means (122) provided in the frame (16); and an electronic controller (46) for controlling operation of the extraction drive means (120) and conveyer means (122) of the transfer device (24). The cassette (18) has a chamber (64) for receiving the notes (66) and an extracting device (232) for discharging the notes (66) in the chamber (64). The extraction drive means (120) operates the extracting device (232) in the cassette (18) to fetch the notes (66) from the cassette (18). The conveyer means (122) transports the notes (66) received from the cassette (18) to an outlet (20) through a passageway (22).

The electronic controller (46) generates drive signals to operate the extraction drive means (120) and conveyer means (122) of the transfer device (24) so that the notes (66) can be successively dispensed from the removably and exchangeably mounted cassette (18) through the passageway (22). In this case, the cassette (18) can be made in light weight because the extracting device (232) can be driven by the extraction drive means (120) attached to the frame (16). The term "note" herein is used to mean all valuable paper such as bill, paper currency, bank notes, coupons, scrip, or other "secure" paper with an associated cash value.

In an embodiment of the instant invention, the cassette (18) comprises a storage area (68), and a diverting device (230) for receiving an unacceptable note (66) from the conveyer means (122) and forwarding the same to the storage area (68). The transfer device (24) comprises at least a sensor means (30, 32) provided by the passageway (22) for detecting the unacceptable note (66) that is moved through the passageway (22), and a diverting means (183) for diverting the unacceptable note (66) from the passageway (22) to a recovery path (48) for the storage area (68) in the cassette (18). Upon detection of the unacceptable note (66) by the sensor means (30, 32), the electronic controller (46) operates the diverting means (183) to guide the note (66) from the passageway (22) to the recovery path (48) in order to recover unacceptable note (66) such as double or false notes without discharging these notes to avoid trouble with users.

The sensor means (30, 32) includes an optical sensor (30, 32) for detecting double notes (66) moved through the passageway (22) to produce a detection signal so that the electronic controller (46) operates the diverting means (183) to divert the note (66) from the passageway (22) to the recovery path (48) when receives the detection signal of the double notes (66) from the optical sensor (30, 32). The optical sensor (30, 32) detects characteristics of the note (66) travelling along the passageway (22) and forwards output signals indicative of the note characteristics to the electronic controller (46). The electronic controller (46) comprises a microprocessor (50) for receiving the output signals from the optical sensor (30, 32) to validate the note (66) in comparison of the received output signals with stored signal parameters. The electronic controller (46) operates the diverting means (183) to divert the note (66) from the passageway (22) to the recovery path (48) when receives the detection signal from the optical sensor (30, 32) that the note (66) is not genuine.

The transfer device (24) comprises an extraction motor (124) and a transport motor (150) both controlled by the electronic controller (46) so that the extraction motor (124) provides the extraction drive means (120) with a drive force, and the transport motor (150) provides the conveyer means (122) with a drive force when the note (66) is extracted from the chamber (64) of the cassette (18).

The transfer device (24) comprises an entry detecting sensor (198) for detecting a leading edge of the note (66) extracted from the cassette (18) to the passageway (22) to produce a detection signal so that the electronic controller (46) ceases operation of the extraction motor (124) when receives the detection signal from the entry detecting sensor (198). Also, the transfer device (24) comprises an outlet sensor (42) for detecting existence of the note (66) which partially extends outward from the passageway (22) through the outlet (20) to produce a detection signal so that the electronic controller (46) ceases operation of the transport motor (150) when receives the detection signal from the outlet sensor (42). Moreover, the transfer device (24) comprises a post-validation sensor (40) for detecting a leading edge of the note (66) to produce a detection signal so that the electronic controller (46) operates the diverting means (183) to divert the note (66) from the passageway (22) to the recovery path (48) when receives the detection signal from the post-validation sensor (40) and decides that the note (66) is unacceptable in view of the outputs from the sensor means (30, 32).

The cassette (18) comprises a casing (62); a lid (60) pivotally mounted on the casing (62) to cover the chamber (64) and storage area (68); and a lock means (70, 72) for securing the cassette (18) to the frame (16) and for securing the lid (60) to the casing (62). The cassette (18) further includes a sealing device (270) which comprises a metallic plate (272) movable in parallel relation to a lid (60) between a shut position for covering delivery and recovery slots (226, 218) and a release position for opening the delivery and recovery slots (226, 218); a closure spring (274) for resiliently urging the metallic plate (272) toward the shut position; and an operative member (275) for moving the metallic plate (272) to the release position against elastic force of the closure spring (274) at the same time the cassette (18) is secured to the frame (16) by operation of the cassette lock means (70).

The lid (60) comprises a delivery slot (226) through which the notes (66) are delivered from the cassette (18) to the passageway (22); and a recovery slot (218) through which the unacceptable note (66) is retired from the passageway (22) to the chamber (64).

The note holding and dispensing device (10) is removably attached to a host machine (12) so that the transfer device (24) is controlled by the host machine (12) and forwards inner information to the host machine (12). Accordingly, the note holding and dispensing device (10) can be manufactured in small size to electrically connect the host machine (12). A chassis (14) may be provided to envelop the frame (16) so that the note holding and dispensing device (10) is detachably attached to the host machine (12) together with the chassis (14).

The extracting device (232) of the cassette (18) includes rollers (258, 260) to which an uppermost one of the notes (66) retained in the chamber (64) is in contact; a first driven gear (234) for rotating the rollers (258, 260); and fin gears (264) adjacent to the rollers (258, 260) for selecting only the uppermost note (66) supplied by the rollers (258, 260).

The chamber (64) and storage area (68) are positioned adjacent to each other in the cassette (18), and the notes (66) in the chamber (64) are supported on a tray (200) of a support (202) so that the notes (66) are resiliently forced toward the extracting device (232) by a compression spring (204).

When the notes (66) are filled in the chamber (64), a pin (203) of a support (202) is engaged with a latch (220) provided on the bottom of the chamber (64) of the cassette (18). The latch (220) is connected with a sliding plate (222) which extends toward a rear surface of a casing (62) so that the sliding plate (222) serves to release engagement of the latch (220) and pin (203) upon contact of the sliding plate (222) to a protrusion (16*a*) of the frame (16) when the cassette (18) is positioned in the frame (16) thereby causing the uppermost note (66) to come into contact to rollers (258, 260).

The first driven gear (234) of the extracting device (232) is meshed with a second driven gear (148) positioned at the bottom of the transfer device (24) to rotate the first driven gear (234) by an extraction motor (124) through the second driven gear (148). The cassette (18) comprises a picker wheel (262) rotatably mounted in the casing (62) opposite to the fin gears (264) for preventing extraction of the double notes (66) at a leading edge of a pathway guide (248), said picker wheel (262) being rotatable only in one direction.

The diverting means (183) comprises a lever (184) rotatably mounted between a discharge position for opening the passageway (22) toward the outlet (20) and a recovery position for opening the passageway (22) toward the diverted slot (44); and an actuator (182) for moving the lever (184) toward one of the discharge and recovery positions. The diverting means (183) further comprises a biasing spring (186) for moving the lever (184) toward the other of the discharge and recovery positions.

The conveyer means (122) comprises a drive roller (190) and a tension roller (192) provided adjacent to the outlet (20) in opposite relation to each other. When the rear end of the note (66) is sandwiched between the drive and tension rollers (190, 192) after the note (66) passes a post-validation sensor (40), the electronic controller (46) ceases operation of the transport motor (150) to stop movement of the note (66).

When the electronic controller (46) judges that the note (66) is unacceptable in view of the optical sensor (30, 32) and also receives the detection signal from the post-validation sensor (40), the electronic controller (46) operates the actuator (182) to rotate the lever (184) to the recovery position.

The frame (16) further comprises an installation detection switch (114) for detecting the cassette (18) in the cavity (112) to produce a detection signal to the electronic controller (46).

The cassette (18) further comprises an empty detection sensor (282) for detecting reduction of the notes (66) in the chamber (64) to produce a detection signal so that the electronic controller (46) operates a warning system when receives the detection signal from the empty detection sensor (282).

DETAILED DESCRIPTION OF THE INVENTION

Figure 1:
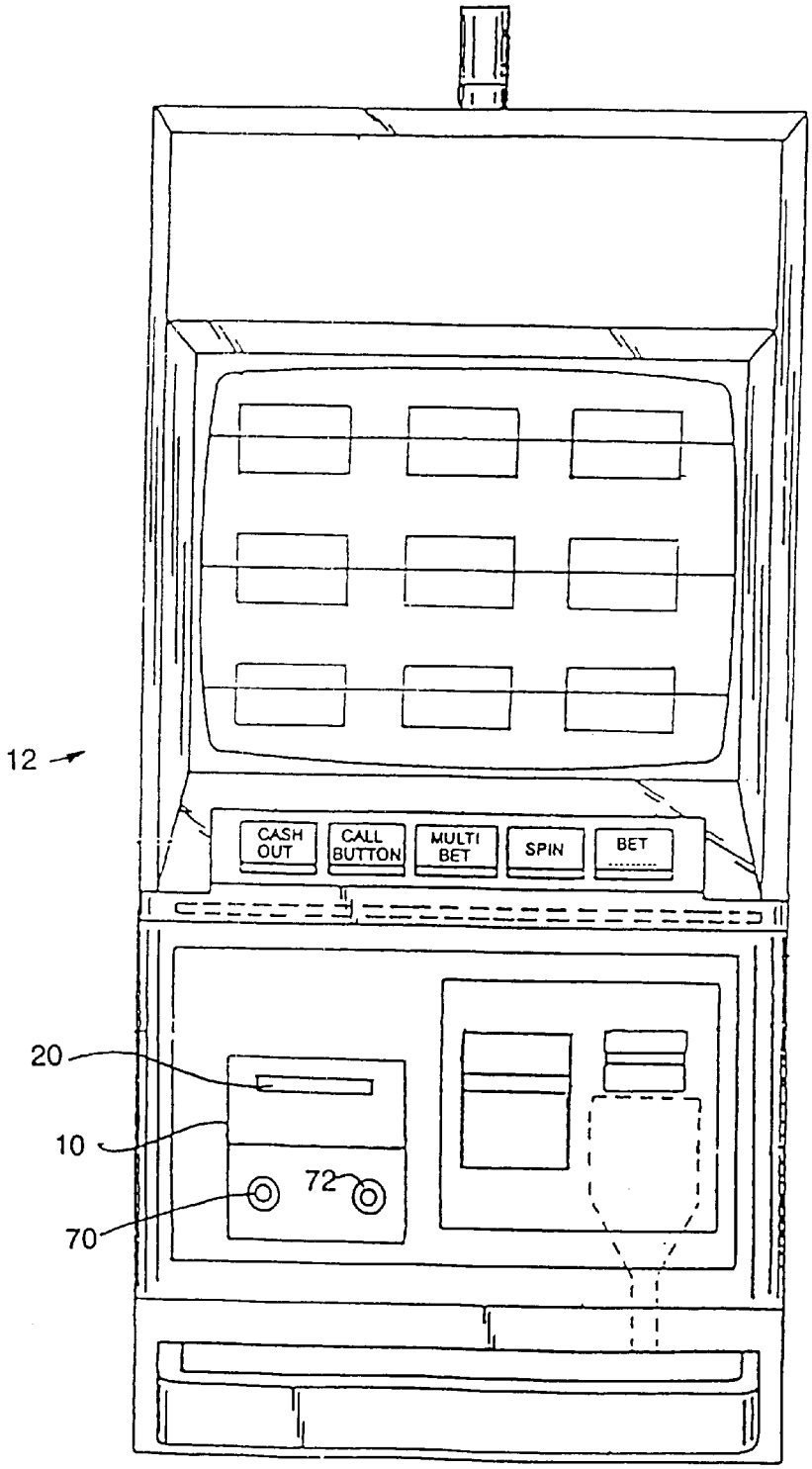
FIG. 1 is a front view of a host machine with a note holding and dispensing device according to the present invention.

As shown in FIG. 1, a note holding and dispensing device 10, which may removably be incorporated into of an electronically controlled host machine 12 such as such as a gaming machine, vending machine or cash box, can hold and conveniently dispense bills to users. The device 10 is electrically controlled by the host machine 12 to dispense notes or currency of a predetermined denomination.

Figure 2:
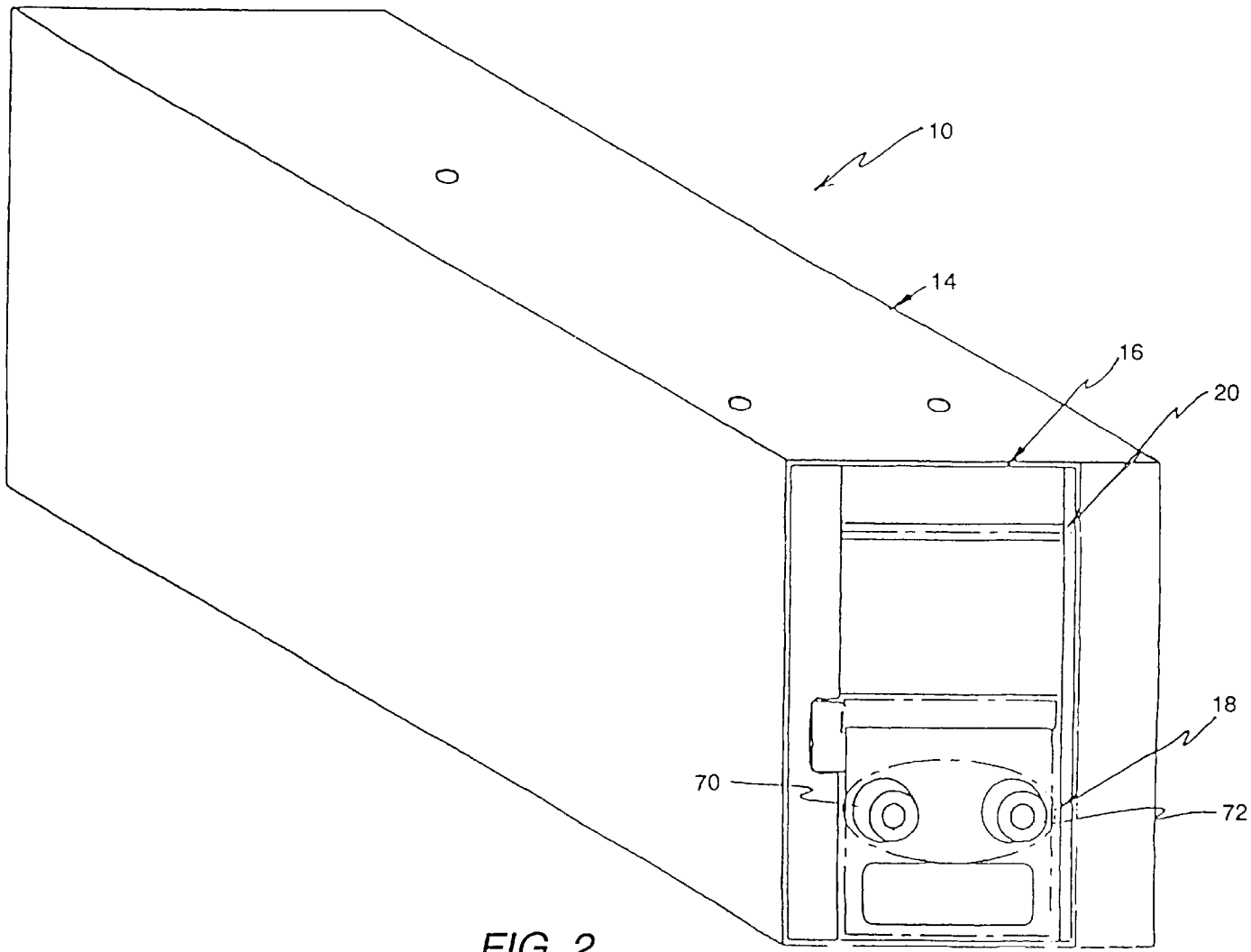
FIG. 2 is a perspective view of the note holding and dispensing device removed from the host machine of FIG. 1.

FIG. 2 depicts a perspective view of the note holding and dispensing device 10 removed from the host machine 12 of FIG. 1. The note holding and dispensing device 10 includes a chassis 14 designed to be secured on or into the host machine 12. The chassis 14 contains a cassette 18 and a transfer device 24 received in a frame 16 and, as shown removed from the chassis 14 in FIGS. 3 and 4, respectively.

Figure 3:
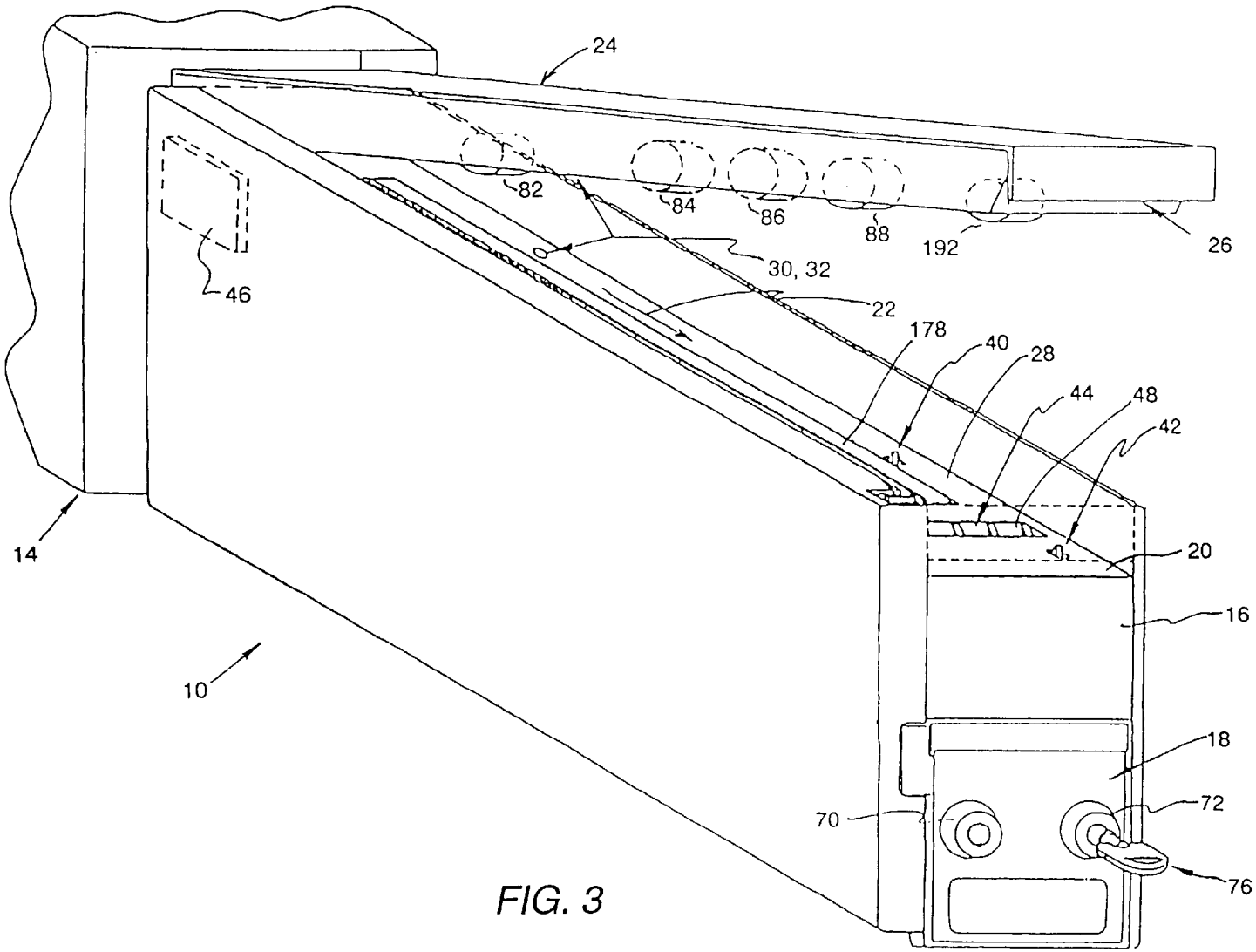
FIG. 3 is an enlarged view of the note holding and dispensing device of FIG. 2 with detail of a transfer device.

As depicted in FIG. 2 and in the view of FIG. 3, the transfer device includes an outlet 20 from which currency can be dispensed. The outlet 20 for dispensing currency is the opening at the end of a passageway 22 defined by a transfer device 24 which generally comprises a lid device 26 and a shelf 28. The lid device 26 and shelf 28 may include one or more sensors (sensor means) 30, 32, such as magnetic or preferably optical infrared sensors, for detecting identifying characteristics of bills and notes and authenticating each bill or note which is to be dispensed.

The transfer device 24 includes "double-bill" check and bill validity detection systems to assure that each bill or note is authentic and is dispensed individually. In the event that a double bill detection event occurs, the frame 16 diverts the double bill to storage area 68 in the note holding and dispensing device 10, by redirecting the travel path of the double bill so that it is not dispensed.

The shelf 28 may also include a post-validation sensor 40 such as a lever sensor to detect the passage and position of the bill or note within the transfer device 24. In addition, the shelf 28 may include an outlet sensor 42 such as a lever sensor which operates to provide a signal to prevent dispensing of a subsequent note prior to removal of a preceding note.

The optical sensors 30 and 32, lever sensors 40 and 42 and the drive mechanisms or motors are coupled to and electronically controlled by an electronic controller 46 within the note holding and dispensing device 10. The electronic controller 46 also provides all control functions and allows communications with the host machine 12 (FIG. 1).

As depicted in FIG. 3, the shelf 28 also includes a diverted slot 44 which provides an opening to a recovery path 48 for allowing double or overlapped bills or other type of rejected note to be stored in the note holding and dispensing device 10.

Figure 4:
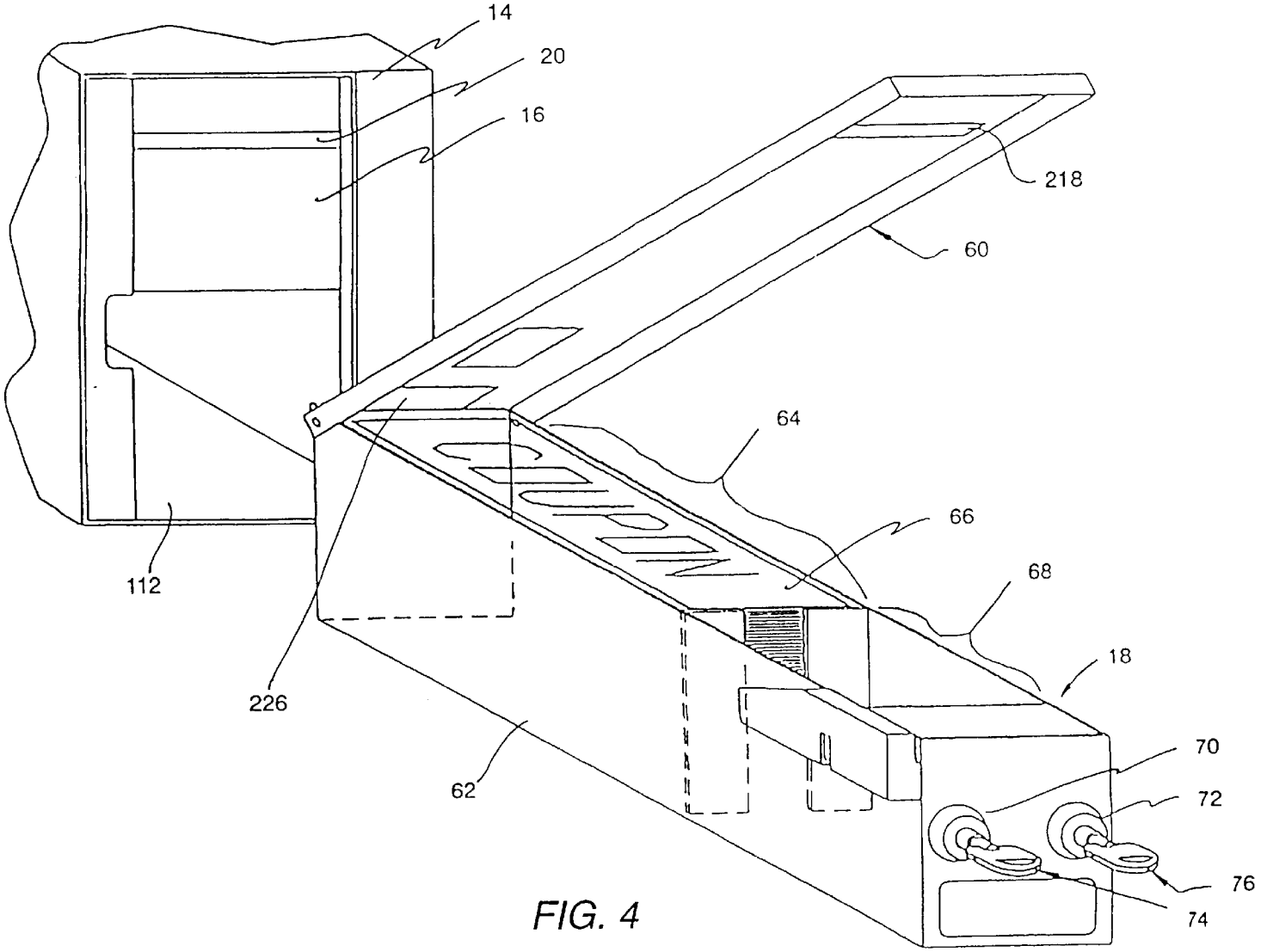
FIG. 4 is a perspective view of a cassette extracted from a frame of FIG. 3.

FIG. 4 depicts a perspective view of the cassette 18 extracted from the frame 16. The cassette 18 includes a lid 60 attached to a frame 62. The frame 62 includes a chamber 64 which allows the storage of a plurality of coupons, currency, notes or bills 66. The note holding and dispensing device 10 stores and dispenses paper currency, bank notes or "secure" paper such as printed coupons or scrip. Such currency is conveniently dispensed from note holding and dispensing device 10, so that it may be accepted by a user. At the front portion of the cassette 18 is a storage area 68 which is positioned below the diverting slot 44 of the shelf 28 upon installation of the cassette 18 into the frame 16.

Preferably, the cassette 18 includes double lock assemblies which include a cassette lock device 70 to be used to secure the cassette 18 within the frame 16, and a lid lock device 72 to be used to secure the lid 60 to the frame 62 to thereby secure access to notes held in the cassette 18 when it is removed from the frame 16. The double lock assembly also preferably requires two keys 74 and 76 respectively, to open the cassette 18 and allow access to the currency storage area 64.

In operation, the frame 16 extracts bills from the cassette 18, verifies that only one bill has been extracted by sensing characteristics of the bill via optical sensors 30 and 32, and sequentially dispenses the bills through outlet 20. The note holding and dispensing device 10 can be configured such that "secure" paper such as coupons or scrip, having exchangeable monetary value, can be dispensed. Such secure paper 66 would preferably be designed to be inserted into and recognized by compatible currency acceptor or bill validator machines.

Figure 5:
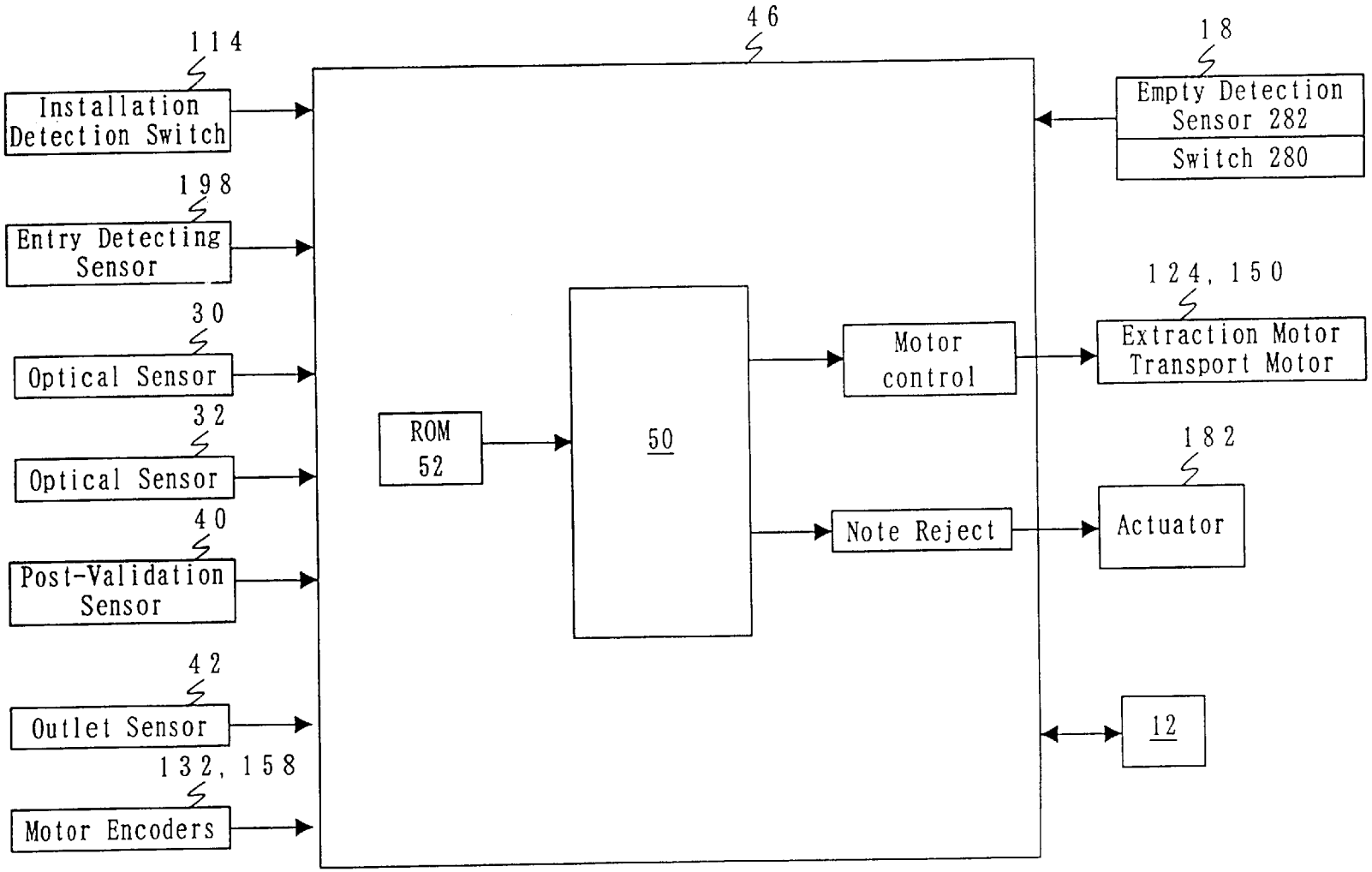
FIG. 5 is a block diagram of the electric control circuit used in the note holding and dispensing device according to the present invention.

FIG. 5 is a block diagram schematically showing a microprocessor controller 46 for the note holding and dispensing device 10 of the present invention. The device 10 is controlled by electronic instructions from the host machine 12. When non-currency secure paper is to be dispensed, such paper preferably incorporates in its design and/or manufacture, characteristics to allow it to be scrutinized and validated by bill validators and other electronic currency validation, stacking and sorting devices. At the heart of the microprocessor controller 46 is a microprocessor 50. The microprocessor 50 relies upon programming instructions stored in a code read-only memory (ROM) 52, in which is stored programming and execution instructions. The microprocessor 50 of the note holding and dispensing device 10, may also be connected to an electronic controller for a host machine including a bill validator so that the components can share control functions relating to the validation proceedings for bills and notes.

Figure 6:
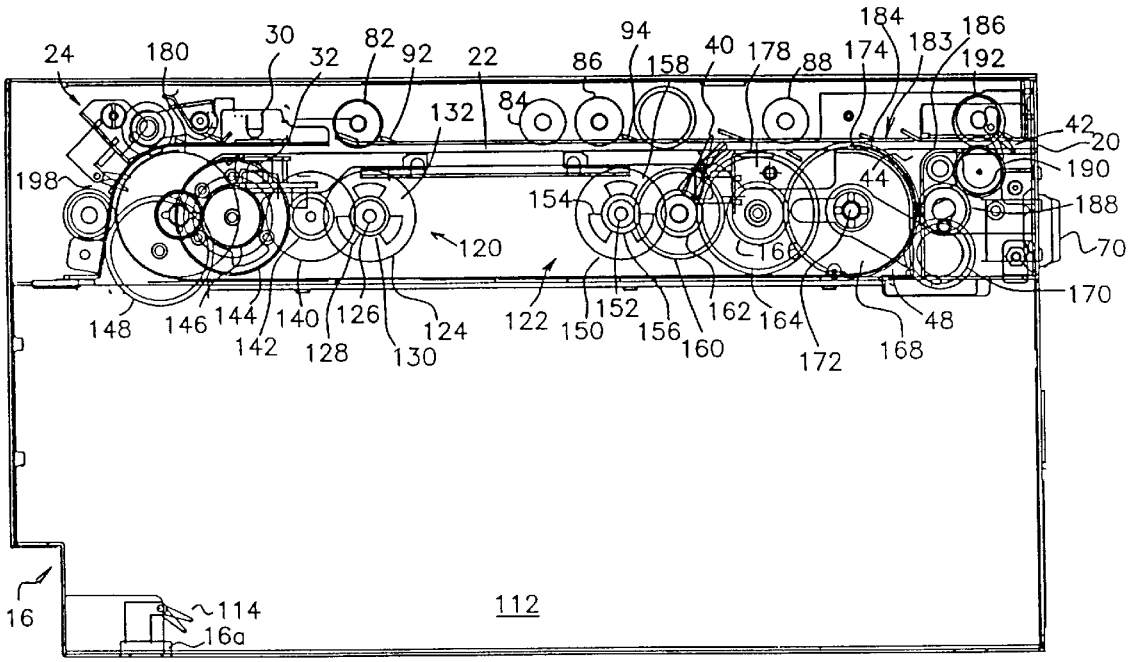
FIG. 6 is a cross sectional side view of the transfer device of FIG. 3.
Figure 7:
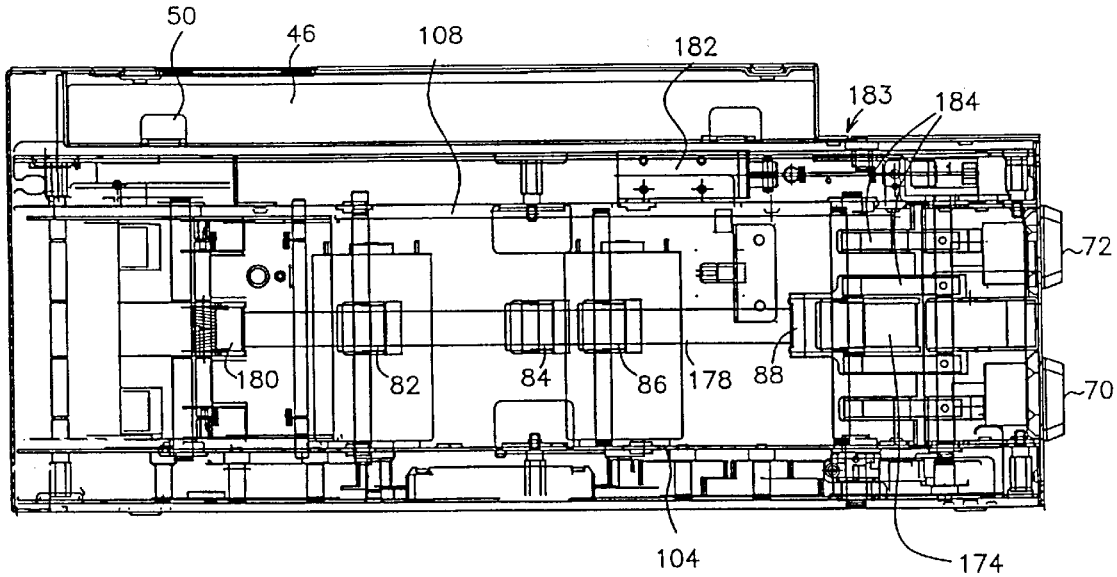
FIG. 7 is a cross sectional top view of the transfer device of FIG. 3.

FIGS. 6 and 7 depict detailed cross-sectional left side and top views, respectively, of the frame 16 of FIG. 3, and particularly the components of the transfer device 24 thereof. In the cross-sectional left side view of FIG. 6, the cassette 18 has been removed from the frame 16. The cassette 18 is intended to be placed in a cavity 112, located in the lower portion of the frame 16. The frame 16 includes a "cassette installed" lever switch 114 as depicted near the bottom left corner, which produces an electric signal to confirm to the electronic controller 46 that the cassette 18 is positioned within the currency bay 112.

Referring to FIGS. 6 and 7, the transfer device 24 of the frame 16 includes an extraction drive means 120 and a conveyer means 122. The extraction drive means 120 provides the driving elements in order to drive a first driven gear 234 located within the cassette 18 which in turn drives rollers 258, 260 to advance a bill out of the cassette 18 and into the passageway 22 of the transfer device 24. The conveyer means 122, by comparison, provides a belt drive system to engage the note with a belt 178 while an entry detecting sensor 198 senses the note once it enters the passageway 22 and advance the note either to the outlet 20 or to and through diverting slot 44 into the storage area 68.

The extraction drive means 120 includes a motor 124 with a shaft 126 on which is mounted both a drive gear 128 and a rotating position indicator 130. The rotating position indicator 130 is sensed by a motor encoder sensor 132 which provides an output signal to the electronic controller 46 indicative of the rotational position of the motor 124 and thereby the rate at which a note is advancing, in order to allow the synchronization of the note advance for purposes of sensor validation of the note information by the electronic controller 46.

The drive gear 128 drives, through a sequence of speed reducing gears 140, 142, 144 and 146, and a second driven gear 148. The second driven gear 148 extends slightly downward from the bottom portion of the transfer device 24 so that it may engage the first driven gear 234 in the cassette 18 described subsequently with respect to FIG. 8.

The conveyer means 122 includes a motor 150 having a shaft 152 on which is mounted a drive gear 154 and a rotational position indicator 156. The rotational position indicator 156 is sensed by a motor encoder sensor 158 which provides output signals to the electronic controller 46 in a manner similar to the motor encoder sensor 132 discussed above.

The drive gear 154 drives, also through a sequence of speed reducing gears 160, 162, 164, 166, a driven gear 168 and an idler gear 170. The driven gear 168 is mounted on a shaft 172 to drive a belt drive wheel 174. The belt drive wheel 174 in turn drives the belt 178 which extends toward the opposite end of the transfer device 24, where it is wrapped about a belt tension roller 180.

As would be seen if viewed from the left side view of FIG. 6, the belt 178 generally rotates in a clockwise direction so that the upper side of the belt 178, advances from the top of belt tension roller 180 to the drive wheel 174, and thus from the back of the transfer device 24 to the front of the transfer device 24, to drive a note which is positioned above the belt 178 from the back to the front of the transfer device 24 along the top of the shelf 28 and within the passageway 22.

As discussed above, the transfer device 24 allows the note holding and dispensing device 10 to direct an invalid bill or note to a storage area 68 in the cassette 18. In order to extract an invalid bill from the passageway 22, a actuator 182 such as solenoid or motor activates a set of deflector or diverting levers 184 which are positioned before the end of the passageway 22 to shift the invalid bill from the passageway 22 to the storage area 68. During normal operation, the actuator 182 is powered on to hold the set of diverting levers 184 down so that a bill can pass along the passageway 22 to outlet 20. If a double or invalid note is detected, power to the actuator 182 is shut off, and a spring 186 biases the diverting levers 184 to rotate into a position whereby they cause an advancing note to rotate along the inner surface diverting levers 184 and the outer surface of the belt drive wheel 174, while driven by belt 178, so that instead of advancing horizontally out through the outlet 20, the bill will rotate around the outside of belt drive wheel 174 through a ninety degree angle, and proceed vertically downward through diverting slot 44.

In order to provide positive tracking near the end of the passageway 22 as well as in the recovery path 48, a tension roller 188 is positioned in front of, and in rotational contact with, the belt drive wheel 174. The combination of the tension roller 188 and the frictional contact with the belt 178 will positively advance a bill positioned therebetween. In addition, the tension roller 188 also drives, by rolling contact, a drive roller 190 positioned just inside of outlet 20. The drive roller 190 is also in frictional rolling contact with a tension roller 192 mounted so as to be vertically positioned above drive roller 190 within the lid device 26.

In order to detect the position of the note as it exits the outlet 20, the mechanical lever sensor 42 is located proximally to outlet 20. The mechanical lever sensor 42 is electrically connected to the electronic controller 46 to communicate an electric signal indicating when a note dispensed by the note holding and dispensing device 10 is removed from the outlet 20. The electronic controller 46 of the note holding and dispensing device 10 may be programmed so that the motor 150 will stop when the trailing end of a bill is held between drive roller 190 and tension roller 192, maintaining the mechanical lever sensor 42 in a closed position, so that only one bill is dispensed at a time. Once the bill is removed, the mechanical lever sensor 42 will open, sending a signal to the electronic controller 46, and the extraction and transport motors 124 and 150 can be activated to transport another bill from the cassette 18 to outlet 20. Thus when it is desired to dispense only one bill at a time, the electronic controller 46 will not direct power to the extraction and transport motors 124 and 150 until the mechanical lever sensor 42 moves to an open position indicating that the last dispensed bill has been removed.

The transfer device 24 also includes the post-validation sensor 40 positioned along the passageway 22 before the diverting slot 44 but spaced from optical sensors 30, 32 a distance greater than the length of a bill traveling along the passageway 22. The post-validation sensor 40 provides an indication of the passage of the leading edge of a bill as it advances along the passageway 22. The post-validation sensor 40 is electrically connected to the electronic controller 46, so that if an invalid or double bill is detected by the optical sensors 30, 32, and identified by the electronic controller 46, its initial contact with lever sensor 40 will cause the electronic controller 46 to activate the bill divert function, shutting off power to the actuator 182, as discussed above.

The lid device 26 further includes a number of tensioning rollers 82, 84, 86, 88 and 192. These tensioning rollers 82, 84, 86, 88 and 192 assist in maintaining the bill essentially flat while it advances along the top surface of belt 178 and shelf 28. Each of the tensioning rollers 82, 84, 86, 88 and 192 is driven by the belt 178, or by the advancement of a bill between the respective tension roller and belt 178. As shown in FIG. 7, the tension rollers 104 and 108 may be pivotally mounted on roller frames 92, 94, respectively, so that in the event a note gets jammed in the passageway 22, it can be removed by lifting the roller frame 92 or 94 to access the passageway 22.

The lid device 26 also includes the optical sensor 30 such as a light sensitive transistor which cooperates with the oppositely disposed optical sensor 32 such as a light emitting diode mounted in the transfer device 24. The optical sensors 30 and 32 provide electronic signal information to the electronic controller 46 concerning identifying characteristics of the bill being transported between optical sensors 30 and 32 along the passageway 22. The optical sensor information is synchronized with the position and travel speed of the bill by the electronic controller 46 so that a "bill characteristics" signal, comprised of the sensed identifying characteristics for the entire length of the bill 60, can be obtained for each note or bill 66. In this manner, the electronic controller 46 can compare the bill characteristics signal to one or more sets of bill characteristics parameters stored in the ROM 52 of the electronic controller 46, to discriminate between a valid single note and a double note or a defective note.

In the instance where the optical sensors 30 and 32 provide a signal which indicates to the electronic controller 46 that a double note is being passed through the passageway 22, or that the note is for some reason invalid, the diverting means 183 are activated so that the note will be diverted into the storage area 68, as discussed above, and another note is extracted from note cassette 18, validated and dispensed.

The lid device 26 also further includes the entry detecting sensor 198 which senses the beginning and leading edges of the note 66 as it advances proximate the beginning of the passageway 22 within the transfer device 24 from the cassette 18. The entry detecting sensor 198 is electrically connected to the electronic controller 46 to provide electrical signal output information thereto. In this manner, and in combination with the motor encoder sensors 132 and 158 for the motors 124 and 150, respectively, the optical sensors 30 and 32 can be precisely controlled in operation over the length of the note as it passes between optical sensors 30 and 32.

Figure 8:
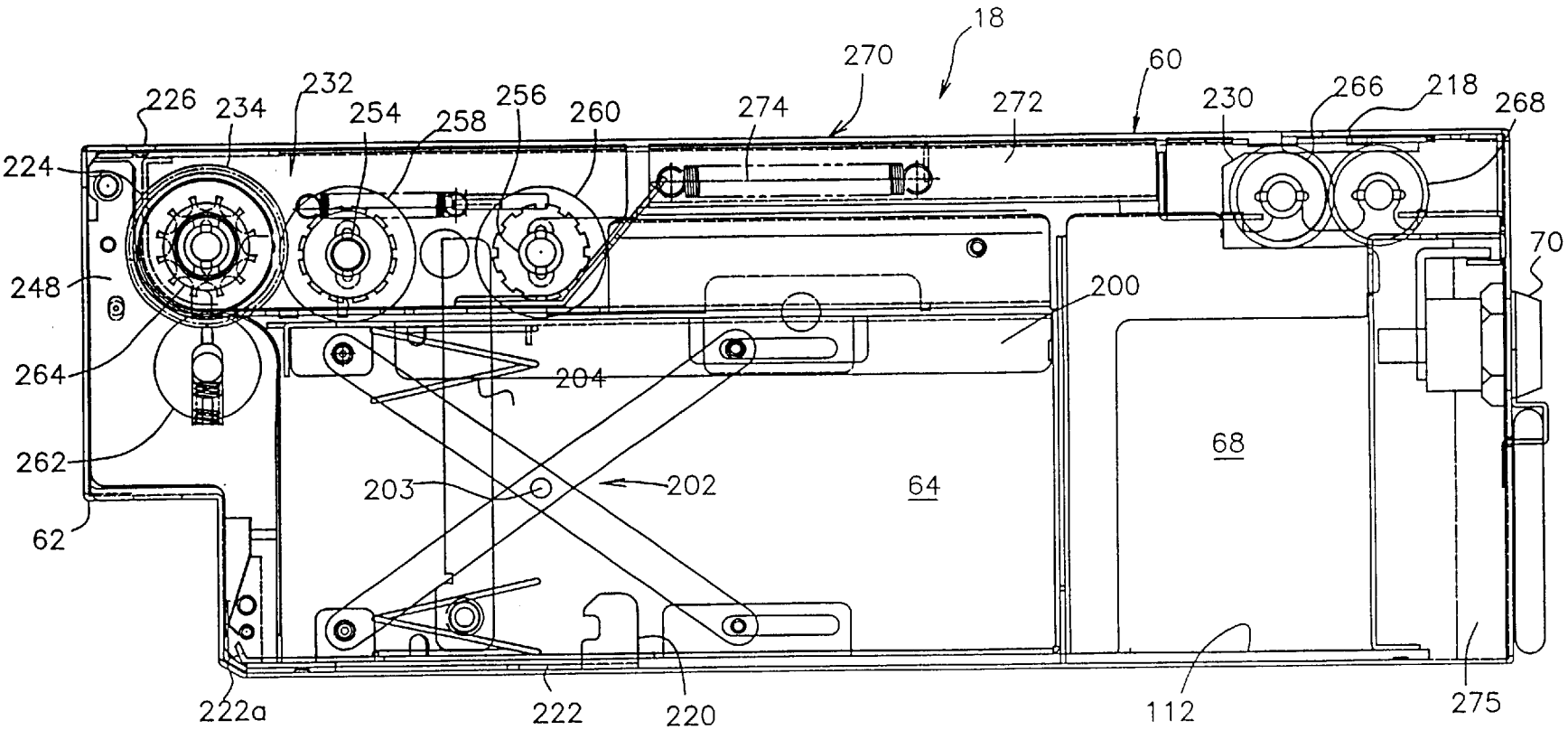
FIG. 8 is a cross sectional side view of the cassette of FIG. 4.
Figure 9:
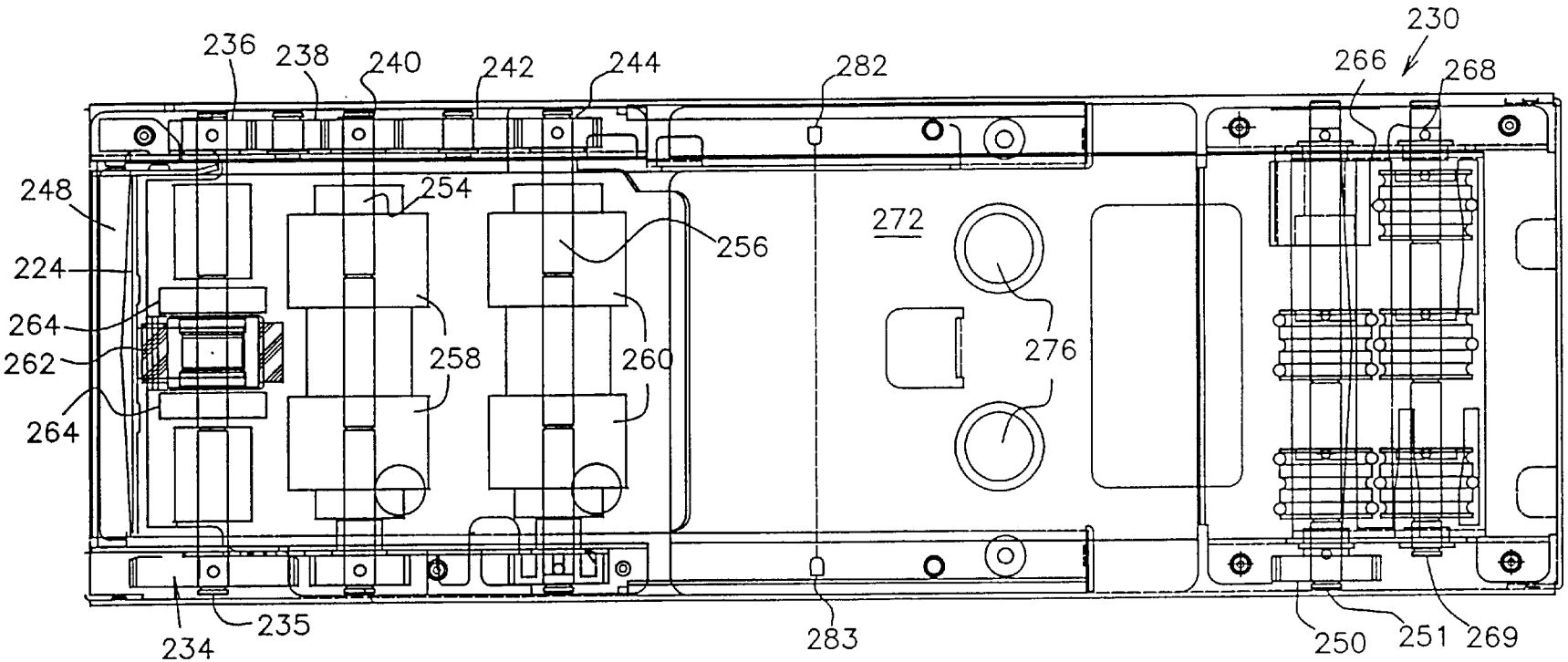
FIG. 9 is a cross sectional top view of the cassette of FIG. 4.

FIG. 8 depicts a detailed side cross-sectional view of the cassette 18 removed from the frame 16. FIG. 9 depicts a detailed top cross-sectional view of the cassette 18. As depicted in FIG. 8 in the operating position, the cassette 18 includes the lid 60 attached to the top of the frame 62 to cover the chamber 64 and storage area 68.

As depicted in FIGS. 8 and 9, the cassette 18 includes a tray 200 for supporting a plurality of coupons, currency, notes, or bills 66 located inside the chamber 64. The tray 200 is attached to a support assembly 202 which is configured to support the tray 200 through vertical translation while also maintaining the tray 200 horizontally flat. The support assembly 202 comprises a pair of links 202*a* and 202*b*, a pin 203 which connects these links 202*a* and 202*b* and a compression spring 204 for upwardly biasing the tray 200. The cassette 18 also includes a latch 220 located on the bottom of the chamber 64 to allow the tray 200 to be latched onto the pin 203 at its vertically lowest position of the tray 200 so that the notes 66 may be placed in the chamber 64. The latch 220 is connected to a sliding plate 222 which extends to the rear surface of frame 62 and is elastically urged outwardly by a spring 222*a* so as to engage the latch 220 with the pin 203. When the cassette 18 is inserted in the cavity 112 of the frame 16, the sliding plate 222 engages a protrusion 16*a* of the frame 16 to cause the latch 220 to unlatch and release the pin 203 of the tray 200. The compression spring 204 will then bias the tray 200 vertically upward until the top bin contacts the rollers 258, 260.

The cassette 18 further includes a extracting device 232 located in the lid 60. The extracting device 232 includes the first driven gear 234 which extends slightly upward from the upper portion of the cassette 18 so that the first driven gear 234 can engage the second driven gear 148 located on the bottom portion of the transfer device 24, described above with respect to FIG. 6. The first driven gear 234 drives, through a sequence of gears 236, 238, 240, 242 and 244, shafts 254 and 256, on which are mounted rollers 258 and 260, respectively, as shown best in FIG. 9. Generally, these rollers 258 and 260 may be made of rubber or another suitable elastic material which can engage and force paper currency or notes along a defined pathway. A pathway guide 248 attached to frame 62, can be for example made of a hard plastic material and is shaped to have a part-cylindrical surface to direct a note or coupon through a pathway 224 and towards slot 226, where the note would then enter the transfer device 24.

A picker wheel 262 is rotatably mounted to the frame 62 at the leading edge of pathway guide 248 to prevent double bills from being extracted from the cassette 18. The picker wheel 262 can be rotated only in one direction to provide one bill at a time to the frame 16. The circumference of the picker wheel 262 comprises a suitable material for causing friction against the leading edge of a note or bill 66. The picker wheel 262 may be configured to only rotate in one direction, which is opposite the direction of travel of the note.

A diverting device 230 is shown in FIG. 9 positioned toward the front of the cassette 18 and positioned in the lid 60 of cassette 18. As shown in FIGS. 6 and 9, the diverting device 230 includes a driven gear 250 that engages the idler gear 170 of the transfer device 24 to drive rollers 266, 268. Driven gear 250 is mounted on a shaft 251 together with a roller 266, and a roller 268 is in driving contact with the roller 266 through rolling contact so that the driven gear 250 can rotate the roller 266 which drives the roller 268 in turn respectively as shown in FIG. 9, for diverting a double bill, or a crumpled or torn bill, to the storage area 68. Any note or bill that is rejected will pass from the frame 16 to the cassette 18 through a slot 218. When the cassette 18 is installed in the frame 16, the slot 218 will be positioned vertically below the recovery path 48. As shown in FIG. 9, the lid 60 may also include openings 276, which allow for visual inspection of the chamber 64, and bills therein.

A sealing device 270 is slidably disposed within the lid 60, where it is biased into a "closed" position by a spring 274. The sealing device 270 includes a metallic plate 272 for covering slots 218 and 226 of the lid 60, for security whenever the cassette 18 is removed from the frame 16. When the cassette 18 is placed inside of the frame 16, the sealing device 270 is unlocked through operation of the cassette lock device 70 which locks the cassette 18 to the frame 16. This allows the metal plate 272 in the sealing device 270 to slide horizontally and uncover the recovery and delivery slots 218 and 226 in the lid 60, thus allowing operation of the note holding and dispensing device 10. The sealing device 270 is implemented to cover the recovery and delivery slots 218 and 226 as well as openings 276 to prevent unauthorized access into the cassette 18.

The top cross-sectional view of the lid 60 of the cassette 18 is shown in greater detail in FIG. 9. The first driven gear 234 is shown connected to gear 236 via a common shaft 235, and the gear 236 drives gears 238, 240, 242 and 244. The gears 240 and 242 are attached to shafts 254, 256 on which are mounted rollers 258 and 260, formed from an elastic substance such as rubber. As understood from FIGS. 8 and 9, first driven gear 234 is attached to fin gears 264 on a common shaft 235 in order to aid the selection of only the top bill from the stack of bills and to further bill or note advancement. Fin gears 264 include a series of fins, comprising a material such as rubber, which are aligned radially around the circumference of a shaft. The fin gears 264 help ensure that only one bill is selected and advanced along the pathway 24 at a time.

Figure 10:
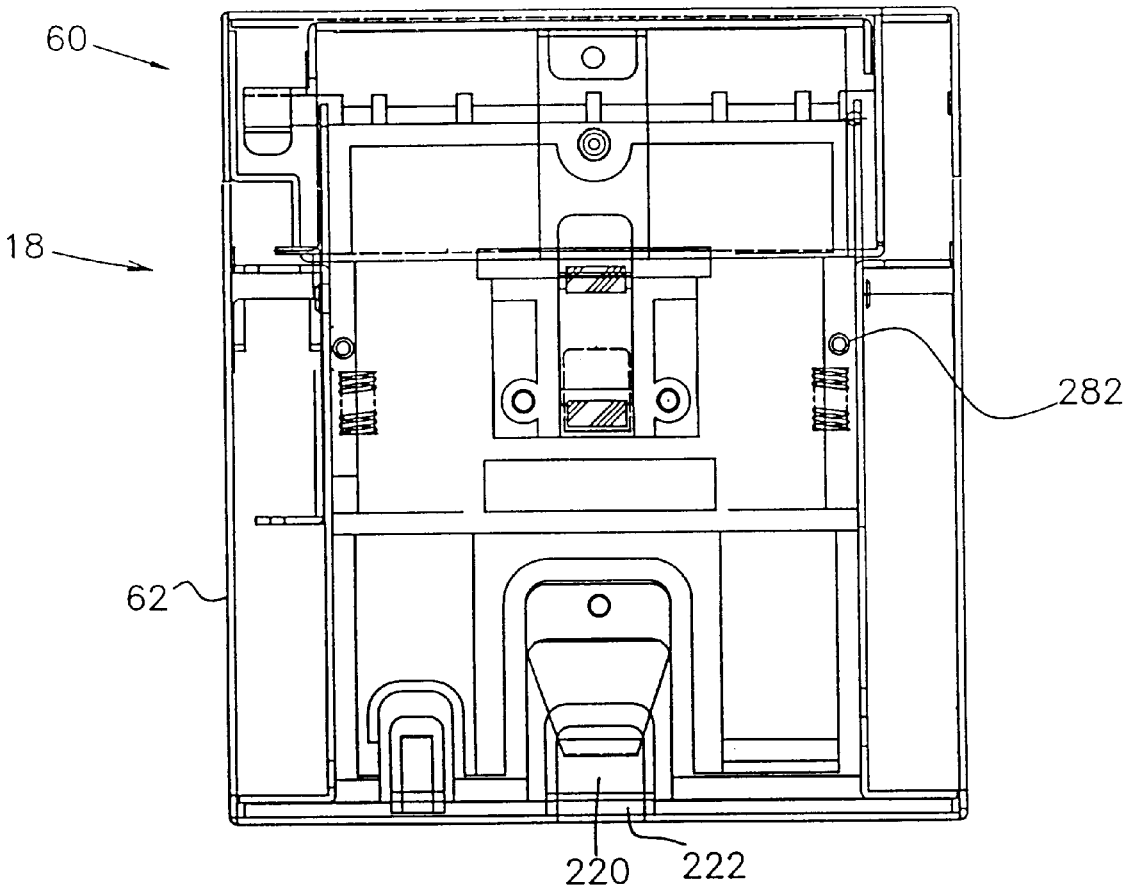
FIG. 10 is a rear view of the cassette of FIG. 4.
Figure 11:
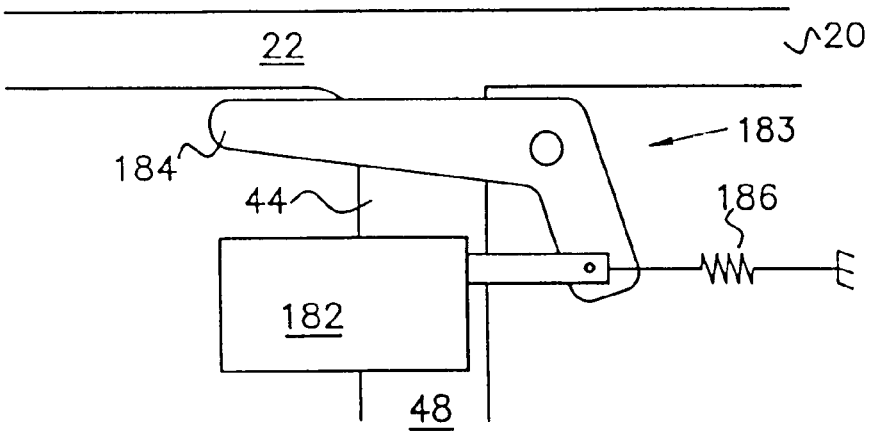
FIG. 11 is a sectional view of a diverting means with a lever in the discharge position.
Figure 12:
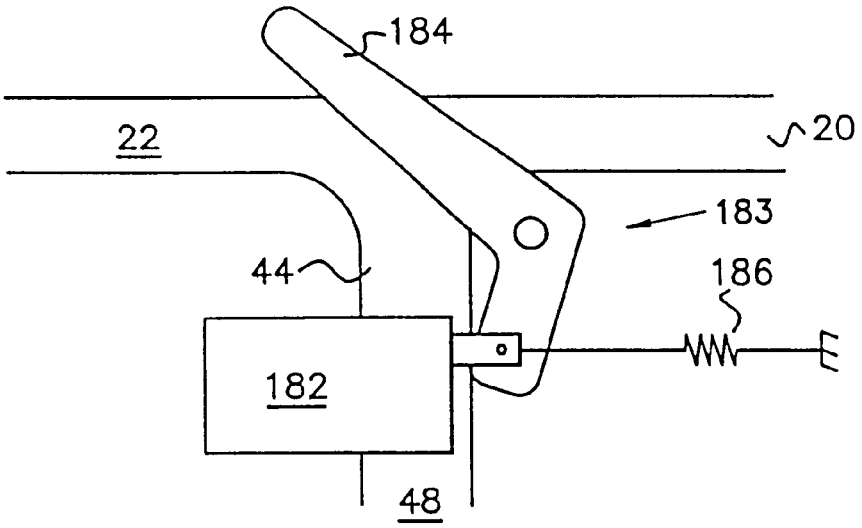
FIG. 12 is a sectional view of the diverting means with the lever in the recovery position.

FIG. 10 depicts a view of the rear surface of the cassette 18 and includes the frame 62 and the lid 60. The distal end of the sliding plate 222 for the latch 220, projects from the rear surface. In addition, the rear surface includes a tray empty switch 280, and a near empty optical sensor 282, which are shown on the rear portion of the frame 62.

In operation, a user lifts the lid 60 of the cassette 18 and places a plurality of coupons, currency, notes, or bills 66 onto the tray 200 which is depressed until held in place by the latch 220 because the pin 203 is brought into engagement with the latch 220. This condition is detected by the tray empty switch 280 which generates a detection signal to the electronic controller 46. After the lid 60 is closed, the cassette 18 is placed inside the transfer device 24 which causes the latch 220 to unlatch, thus releasing the tray 200. Accordingly, the installation detection switch 114 is turned on to produce a detection signal which is forwarded to the electronic controller 46 to recognize the installation of the cassette 18. Simultaneously, the sliding plate 222 is brought into contact with the protrusion 16*a* of the frame 16 to push the latch 220 so that the pin 203 is disengaged from the latch 220 to release the tray 200. Thus, the compression spring 204 then forces the tray 200 upward, causing the uppermost bill 66 to come into contact with the extracting device 232. In this condition, the cassette 18 is locked to the frame 16 by operation of the cassette lock device 70 which simultaneously moves the operative member 275 to slide the metallic plate 272 from the shut position to the release position to open the delivery and recovery slots 226 and 218 to the transfer device 24. The driven gear 250 is brought into engagement with the idle gear 170 of the transfer device 24, and the first driven gear 234 is brought into engagement with the second driven gear 148.

When a signal is received from the electronic controller 46 of the note holding and dispensing device 10, the extracting device 232 activates the rollers 258, 260, picker wheel 262 and fingers 264 to advance a single bill or note along pathway 224 to exit the cassette 18 at slot 226. Thus, the bill 66 is first advanced along a horizontal path towards the rear section of cassette 18. During this transit operation, the picker wheel 262 is designed to prevent more than one note or bill from advancing along the pathway 224. As the leading edge of the bill is slid into the pathway guide 248, the bill is forced by the pathway guide 248 to rotate ninety degrees so that it is directed upward, towards the top of the cassette 18 where it exits out of the slot 226 and enters the passageway 22 in the frame 16.

When the entry detecting sensor 198, as shown in FIG. 6, is actuated by the leading edge of the advancing bill, the trailing edge of the bill will have passed beyond rollers 258 and 260. Accordingly, the electronic controller 46 sends a signal shutting off the extraction motor 124 so that the extracting device 232 will no longer be actively driven and the rollers 258 and 260 will stop rotating and rest on the next bill. Therefore, the next bill in the stack will be held in place in the chamber 64, and will not advance along with the bill being pulled through the passageway 22. In addition, the rollers 258 and 260 will stop rotating as soon as the trailing edge of the bill has advanced from underneath rollers 258 and 260.

By the time the leading edge of the bill extracted from the cassette 18 causes the entry detecting sensor 198 to move to the closed position, the leading edge of the bill has come into contact with the belt 178 which is being driven by transport motor 150. The motor encoder sensor 158 associated with the rotating position indicator 156 for motor 150 provides a signal to the electronic controller 46 which can be interpreted to determine the exact speed of the translation of the bill along the passageway 22. Thus, the electronic controller 46 will be able to determine when the leading edge of the bill 66 reaches the optical sensors 30 and 32. During the time that the bill passes length wise between optical sensors 30 and 32, the bill would be moving at a constant speed so that bill characteristic data produced by the outputs of sensors 30 and 32 may be communicated to the electronic controller 46 in accordance with the linear length of the bill. By the time the length of the bill has passed between sensors 30 and 32, the electronic controller 46 will have determined whether the bill is a valid bill, or if there are two bills stuck together forming a double bill. At the time that the bill has completed its passage between sensors and 30 and 32, it will be in approximately the midpoint of the passageway 22 and the leading edge will have not yet reached the post-validation sensor 40. As soon as the leading edge trips the post-validation sensor 40, in the event that a double bill or an invalid bill has been detected, the electronic controller 46 will shut off power to the actuator 182 and the diverted levers 184 will rotate upwards so as to deflect the leading edge of the bill from passageway 22 into recovery path 48, the bill will be turned through a ninety degree rotation to proceed vertically downward into the storage area 68.

When the sensor data from sensors 30 and 32 is interpreted by the electronic controller 46 as indicative of a valid note or secure script, then the diverted levers 184 will remain in the retracted position and the leading edge of the bill will exit through outlet 20. Again, using the information from the motor encoder sensor 158 which senses the rotational position of the drive motor 150, the electronic controller 46 can calculate the proper length of time to power the drive motor 150 to allow the trailing edge of the bill being dispensed to advance to a point where it is held between drive roller 190 and tension roller 192. When the trailing edge of the bill is positioned between drive roller 190 and tension roller 192, the electronic controller 46 will shut off power to the transport motor 150 and the advancement of the bill will be stopped. The trailing edge of the bill will be held between drive roller 190 and tension roller 192. The user may then simply pull the bill from the machine to accept the dispensed bill. Once the trailing edge of the bill passes lever sensor 42, the lever sensor 42 will move to the open position and the electronic controller 46 can determine if another bill is to be dispensed. If so, the extraction and transport motors 124 and 150 can be activated and, as discussed above, the procedure for dispensing a bill is repeated.

When the tray 200 is reduced to a small number of bills or notes, such as approximately 10, the near-end optical sensor 282 sends a signal to the electronic controller 46 to activate a warning system. In addition, when the tray 200 is completely empty, the tray empty switch 280 sends a "tray empty" signal to the electronic controller 46. This information may then be communicated to the host machine 12 (FIG. 1).

The configuration of the note holding and dispensing device 10 and the elements thereof are preferably designed to enhance security of the currency contained in the note holding and dispensing device, including during transport of the cassette 18 when it is withdrawn from the note holding and dispensing device 10. Thus, it should be noted that the system operates in a mode whereby only one bill is extracted from the cassette 18, it is then validated and, only if valid, dispensed by the note holding and dispensing device 10. If for any reason the note is not validated by the information provided by optical sensors 30 and 32, it is simply diverted into the storage area 68. Specifically, immediately after the leading edge of the bill turns the post-validation sensor 40 on, if the electronic controller 48 detects double bills or unacceptable bill, it ceases output to the actuator 182 to move the diverting means 183 upward by elastic force of the biasing spring 186 so as to deflect the leading edge of the bill from passageway 22 into recovery path 48. Thus, the bill will be turned through a ninety degree rotation to proceed vertically downward into the storage area 68. By default, the electronic controller 46 must determine that the bill should pass, otherwise it is automatically diverted to the storage area 68.

The foregoing detailed description is provided to allow those skilled in the art to appreciate the present invention. It is contemplated, however, that such persons will readily understand the application of the note holding and dispensing device detailed herein in various types of machines which are available. Therefore, the invention and protection afforded by this disclosure will properly be understood to be limited and defined only by the scope of the appended claims.

What is claimed are:

1. A note holding and dispensing device with a note cassette comprising:

a frame (16) formed with a cavity (112);

a cassette (18) removably positioned in said cavity (112) of said frame (16), said cassette (18) having a chamber (64) for receiving a plurality of notes (66) and an extracting device (232) for discharging the notes (66) in the chamber (64);

a transfer device (24) comprising an extraction drive means (120) and a conveyer means (122) provided in said frame (16), said extraction drive means (120) operating said extracting device (232) in said cassette (18) to fetch the notes (66) from said cassette (18), said conveyer means (122) transporting the notes (66) received from said cassette (18) to an outlet (20) through a passageway (22); and an electronic controller (46) for controlling operation of said extraction drive means (120) and conveyer means (122) of said transfer device (24);

wherein said cassette (18) further comprises an empty detection sensor (282) for detecting reduction of the notes (66) in said chamber (64) to produce a detection signal;

said electronic controller (46) operates a warning system when receives the detection signal from the empty detection sensor (282).

2. A note holding and dispensing device according to claim 1, wherein said extracting device (232) comprises rollers (258, 260) to which an uppermost one of the notes (66) retained in said chamber (64) is in contact; and a first driven gear (234) for rotating said rollers (258, 260), said first driven gear (234) being detachably engaged with a second driven gear (148) of said extraction drive means (120).

3. A note holding and dispensing device according to claim 1, wherein said chamber (64) is formed in said cassette (18);

the notes (66) in said chamber (64) are supported on a tray (200) of a support (202) so that a compression spring (204) resiliently urges the notes (66) toward said extracting device (232).

4. A note holding and dispensing device according to claim 1, wherein said extracting device (232) comprises fin gears (264) adjacent to said rollers (258, 260) for selecting only the uppermost note (66) supplied by said rollers (258, 260), said first driven gear (234) of the extracting device (232) is meshed with the second driven gear (148) positioned at the bottom of said transfer device (24) to rotate said first driven gear (234) by an extraction motor (124) through said second driven gear (148).

5. A note holding and dispensing device according to claim 1, wherein said cassette (18) comprises a picker wheel (262) rotatably mounted in said casing (62) opposite to fin gears (264) for preventing extraction of double notes (66) at a leading edge of a pathway guide (248), said picker wheel (262) being rotatable only in one direction.

6. A note holding and dispensing device according to claim 1, wherein said cassette (18) comprises a storage area (68), and a diverting device (230) for receiving an unacceptable note (66) from said conveyer means (122) and forwarding the same to said storage area (68);

said transfer device (24) comprises at least a sensor means (30, 32) provided by said passageway (22) for detecting the unacceptable note (66) moved through said passageway (22), and a diverting means (183) for diverting the unacceptable note (66) from said passageway (22) to a recovery path (48) for the storage area (68) in the cassette (18);

whereby upon detection of the unacceptable note (66) by the sensor means (30, 32), said electronic controller (46) operates said diverting means (183) to guide the note (66) from the passageway (22) to the recovery path (48).

7. The note holding and dispensing device according to claim 6, wherein said diverting means (183) comprises a lever (184) rotatably mounted between a discharge position for opening said passageway (22) toward said outlet (20) and a recovery position for opening said passageway (22) toward diverted slot (44); and an actuator (182) for moving said lever (184) toward one of said discharge and recovery positions.

8. The note holding and dispensing device according to claim 7, wherein said diverting means (183) further comprises a biasing spring (186) for moving said lever (184) toward the other of said discharge and recovery positions.

9. The note holding and dispensing device according to claim 6, wherein said sensor means (30, 32) includes an optical sensor (30, 32) for detecting double notes (66) moved through said passageway (22) to produce a detection signal;

said electronic controller (46) operates said diverting means (183) to divert the note (66) from the passageway (22) to the recovery path (48) when receives the detection signal of the double notes (66) from the optical sensor (30, 32).

10. The note holding and dispensing device according to claim 9, wherein said optical sensor (30, 32) detects characteristics of the note (66) travelling along the passageway (22) and forwards output signals indicative of the note characteristics to the electronic controller (46);

said electronic controller (46) comprises a microprocessor (50) for receiving the output signals from the optical sensor (30, 32) to validate the note (66) in comparison of the received output signals with stored signal parameters;

said electronic controller (46) operates said diverting means (183) to divert the note (66) from the passageway (22) to the recovery path (48) when receives the detection signal from the optical sensor (30, 32) indicating that the note (66) is not genuine.

11. A note holding and dispensing device according to claim 1, wherein said transfer device (24) comprises an extraction motor (124) and a transport motor (150) both controlled by said electronic controller (46);

said extraction motor (124) provides said extraction drive means (120) with a drive force, and said transport motor (150) provides said conveyer means (122) with a drive force when said note (66) is extracted from the chamber (64) of the cassette (18).

12. The note holding and dispensing device according to claim 11, wherein said transfer device (24) comprises an entry detecting sensor (198) for detecting a leading edge of the note (66) extracted from the cassette (18) to the passageway (22) to produce a detection signal;

said electronic controller (46) ceases operation of said extraction motor (124) when receives the detection signal from said entry detecting sensor (198).

13. The note holding and dispensing device according to claim 11, wherein said transfer device (24) comprises an outlet sensor (42) for detecting existence of the note (66) which partially extends outward from the passageway (22) through the outlet (20) to produce a detection signal;

said electronic controller (46) ceases operation of said transport motor (150) when receives the detection signal from said outlet sensor (42).

14. A note holding and dispensing device according to claim 1 wherein said transfer device (24) comprises a post-validation sensor (40) for detecting a leading edge of the note (66) to produce a detection signal;

said electronic controller (46) operates said diverting means (183) to divert the note (66) from the passageway (22) to the recovery path (48) when receives the detection signal from the post-validation sensor (40) and decides that the note (66) is unacceptable in view of the outputs from the sensor means (30, 32).

15. The note holding and dispensing device according to claim 14, wherein said electronic controller (46) operates said actuator (182) to rotate said lever (184) to the recovery position when said electronic controller (46) judges that the note (66) is unacceptable in view of said optical sensor (30, 32) and also receives the detection signal from said post-validation sensor (40).

16. A note holding and dispensing device according to claim 1, wherein said cassette (18) further comprises a casing (62); a lid (60) pivotally mounted on said casing (62) to cover said chamber (64) and a storage area (68); and a lock means (70, 72) for securing said cassette (18) to said frame (16) and for securing said lid (60) to said casing (62).

17. The note holding and dispensing device according to claim 15, wherein said lid (60) comprises a delivery slot (226) through which said notes (66) are intermittently delivered from said cassette (18) to the passageway (22); and a recovery slot (218) through which the unacceptable note (66) is retired from the passageway (22) to the storage area (68).

18. A note holding and dispensing device according to claim 1, wherein said cassette (18) further comprises a sealing device (270) which has a metallic plate (272) movable in parallel relation to a lid (60) between a shut position for covering delivery and recovery slots (226, 218) and a release position for opening said delivery and recovery slots (226, 218); a closure spring (274) for resiliently urging said metallic plate (272) toward the shut position; and an operative member (275) for moving said metallic plate (272) to the release position against elastic force of the closure spring (274) at the same time said cassette (18) is secured to said frame (16) by operation of said lock means (70).

19. A note holding and dispensing device according to claim 1, wherein a pin (203) of a support (202) is engaged with a latch (220) provided on the bottom of said chamber (64) of the cassette (18) when said notes (66) are filled in said chamber (64);

said latch (220) is connected with a sliding plate (222) which extends toward a rear surface of a casing (62);

when said cassette (18) is positioned in said frame (16), said sliding plate (222) is brought into contact to a protrusion (16*a*) of said frame (16) so that said sliding plate (222) serves to release engagement of the latch (220) and pin (203), thereby causing the uppermost note (66) to come into contact to rollers (258, 260).

20. A note holding and dispensing device according to claim 1, wherein said conveyer means (122) comprises a drive roller (190) and a tension roller (192) provided adjacent to said outlet (20) in opposite relation to each other;

when the rear end of said note (66) is sandwiched between said drive and tension rollers (190, 192) after the note (66) passes a post-validation sensor (40), said electronic controller (46) ceases operation of a transport motor (150) to stop movement of the note (66).

21. A note holding and dispensing device according to claim 1, wherein said frame (16) further comprises an installation detection switch (114) for detecting said cassette (18) in said cavity (112) to produce a detection signal to said electronic controller (46).

* * * * *